US008349777B2

(12) United States Patent
McDougall

(10) Patent No.: US 8,349,777 B2
(45) Date of Patent: Jan. 8, 2013

(54) LUBRICATING COMPOSITION CONTAINING 1,3-DIOXOLANE-4-METHANOL COMPOUNDS AS ANTIWEAR ADDITIVES

(75) Inventor: Patrick J. McDougall, Berkeley, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 94 days.

(21) Appl. No.: 12/951,829

(22) Filed: Nov. 22, 2010

(65) Prior Publication Data

US 2012/0129744 A1 May 24, 2012

(51) Int. Cl.
*C10M 129/20* (2006.01)

(52) U.S. Cl. ..... 508/307; 549/453

(58) Field of Classification Search ..... 508/307; 549/453

See application file for complete search history.

(56) References Cited

U.S. PATENT DOCUMENTS 3,248,327 A * 4/1966 Whitaker ..... 508/307
3,846,319 A * 11/1974 Hotten ..... 508/307
4,575,558 A * 3/1986 Mai et al. ..... 549/453
4,792,411 A * 12/1988 Walsh ..... 508/308
4,956,285 A * 9/1990 De Smet ..... 435/126
5,182,209 A * 1/1993 Geerlof et al. ..... 435/280
5,523,010 A * 6/1996 Sorensen et al. ..... 508/307
5,744,064 A * 4/1998 Galante et al. ..... 508/307
5,744,065 A * 4/1998 Galante et al. ..... 508/307
6,124,479 A * 9/2000 Hinoue et al. ..... 549/334
6,143,908 A * 11/2000 Hinoue et al. ..... 549/453
7,790,909 B2 * 9/2010 Sato et al. ..... 549/430
7,838,692 B2 * 11/2010 Sato et al. ..... 549/369
8,158,564 B2 * 4/2012 Sato et al. ..... 508/307

* cited by examiner

*Primary Examiner* — Ellen McAvoy
(74) *Attorney, Agent, or Firm* — Joseph P. Foley

(57) ABSTRACT

Disclosed are lubricating oil compositions comprising a major amount of an oil of lubricating viscosity; and from 0.05 to 10 weight % based upon the total lubricating oil composition of a 1,3-dioxolane-4-methanol compound of the formula I:

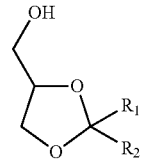

wherein:

$R_1$ and $R_2$ are each independently hydrogen, alkyl or alkenyl, wherein the sum of carbon atoms for $R_1$ and $R_2$ is 6 carbon atoms or less.

15 Claims, No Drawings

LUBRICATING COMPOSITION CONTAINING 1,3-DIOXOLANE-4-METHANOL COMPOUNDS AS ANTIWEAR ADDITIVES

FIELD OF INVENTION

Disclosed are lubricating compositions containing 1,3-dioxolane-4-menthanol optionally substituted with low alkyl or low alkenyl groups having a total carbon sum of six carbon atoms or less. Lubricating oil compositions containing these 1,3-dioxolane-4-methanol compounds provide wear protection for engine oils and gear sets.

BACKGROUND

Zinc dithiophosphates (ZnDTP) have long been used as antiwear additives and antioxidants in engine oils, automatic transmission fluids, hydraulic fluids and the like. Conventional engine oil technology relies heavily on ZnDTP to provide extremely low cam and lifter wear and favorable oxidation protection under severe conditions. ZnDTP operates under mixed-film lubrication conditions by reacting with rubbing metal surfaces to form protective lubricating films. The mixed-film lubrication regime is a mixture of full-film (hydrodynamic) lubrication wherein the lubricating film is sufficiently thick to prevent metal-to-metal contact and boundary lubrication wherein the lubricating film thickness is significantly reduced and more direct metal-to-metal contact occurs.

However, a problem has arisen with respect to the use of ZnDTP, because phosphorus and sulfur derivatives poison catalyst components of catalytic converters. This is a major concern as effective catalytic converters are needed to reduce pollution and to meet governmental regulations designed to reduce toxic gases such as, for example, hydrocarbons, carbon monoxide and nitrogen oxides, in internal combustion engine exhaust emission. Therefore, it would be desirable to reduce the phosphorus and sulfur content in engine oils so as to maintain the activity and extend the life of the catalytic converter.

There is also governmental and automotive industry pressure towards reducing the phosphorus and sulfur content. As the environmental regulations governing tailpipe emissions have tightened, the allowable concentration of phosphorus in engine oils has been significantly reduced with further reductions in the phosphorus content of engine oils being likely.

There is currently great interest therefore in new antiwear additives that contain little or no sulfated ash, phosphorus, and sulfur (SAPS). Such additives could reduce or eliminate the need for zinc dialkyl dithiophosphate (ZNDTP) in lubricating oils. There have been many approaches to solving this problem, though very few antiwear additives contain no sulfur, phosphorus, or metal species. The present invention is directed in part to providing antiwear to lubricating oil compositions by employing a substituted 1,3-dioxolane-4-methanol compound.

1,3-dioxolanes and numerous derivatives are known. They have been used as a solvent for cosmetics, perfumes, paints, plastics, etc. (see U.S. Pat. Nos. 4,861,764; 5,686,098 and US2008/0280997): they have also been used as disinfectants and aerosols and some are stated to be physicologically active (see Chem. Rev, 1967, 67(4) pp 427-440). 1,3-dioxolanes can be stereoactive and many are prepared as intermediates for the preparation of optically active beta-agonists or antagonists (see U.S. Pat. Nos. 4,575,558 and 5,190,876). U.S. Pat. Nos. 4,374,998 and 4,435,315 discloses branched chain olefin and alkyl derivatives of 1,3-dioxolane for use as flavoring and perfume agents. U.S. Pat. No. 3,883,558 discloses alkyl esters of 1,3-dioxolanes for use a flavorant in an aroma composition. For other flavoring and aroma-enhancing agents see U.S. Pat. Nos. 4,262,030; 3,748,334. Acetal esters and ketal esters derived from glycerol and ethoxylated derivatives are known as fuel additives and for use in lubricating oils (see U.S. Pat. Nos. 5,268,007; 5,093,018; 4,792,411; WO 2008/059155 and US 2008/0234152) and more recently for biofuels (WO 2006/084048; US 2008/0293602; US 2009/0126262; US 2010/0094027). U.S. Pat. No. 7,790,909 is directed to metal working fluids containing a 2-alkyl-4,4-dialkyl-1,3-dioxolane.

SUMMARY

A lubricating oil composition comprising a major amount of an oil of lubricating viscosity; and from 0.05 to 10 weight % based upon the total lubricating oil composition of a 1,3-dioxolane-4-methanol compound of the formula I:

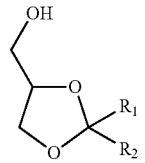

wherein:

$R_1$ and $R_2$ are each independently hydrogen, alkyl or alkenyl group; wherein the sum of carbon atoms for $R_1$ and $R_2$ is 6 carbon atoms or less. In one aspect, $R_1$ and $R_2$ are each selected to be hydrogen, for example the compound is (1,3-dioxolan-4-yl)methanol. In another aspect, $R_1$ is hydrogen and $R_2$ is a C1-C6 alkyl or alkenyl group. In this regard where $R_2$ is alkyl particularly preferred compounds are selected from the group consisting of: (2-methyl-1,3-dioxolan-4-yl)methanol, (2-ethyl-1,3-dioxolan-4-yl)methanol, (2-propyl-1,3-dioxolan-4-yl)methanol, (2-pentyl-1,3-dioxolan-4-yl)methanol, (2-hexyl-1,3-dioxolan-4-yl)methanol(2-methyl-1,3-dioxolan-4-yl)methanol, (2-sec-butyl)-1,3-dioxolan-4-yl)methanol, (2-pentan-2-yl)-1,3-dioxolan-4-yl)methanol, (2-hexyl-2-yl)-1,3-dioxolan-4-yl)methanol, (2-(3-methylpentan-2-ylpentan-2yl)-1,3-dioxolan-4-yl)methanol, (2-(4-methylpentan-2-ylpentan-2yl)-1,3-dioxolan-4-yl)methanol, (2-isopentyl-1,3-dioxolan-4-yl)methanol, (2-(2,3-dimethylbutyl)-1,3-dioxolan-4-yl)methanol, (2-(3,3-dimethylbutyl)-1,3-dioxolan-4-yl)methanol, 2-neopentyl-1,3-dioxolan-4-yl)methanol. Where $R_2$ is alkenyl the preferred vinyl containing (1,3-dioxolan-4-yl)methanol containing compounds are preferably selected from the group consisting of: (2vinyl-1,3-dioxolan-4-yl)methanol, (2-(prop-1-en-1-yl)-1,3-dioxolan-4-yl)methanol, (2-(but-1-en-1-yl)-1,3-dioxolan-4-yl)methanol, (2-(pent-1-en-1-yl)-1,3-dioxolan-4-yl)methanol, (2-(3-methylbut-1-en-1-yl)-1,3-dioxolan-4-yl)methanol, (2-allyl-1,3-dioxolan-4-yl)methanol, (2-(but-2-en-1-yl)-1,3-dioxolan-4-yl)methanol, (2-(pent-2-en-1-yl)-1,3-dioxolan-4-yl)methanol, (2-(hex-2-en-1-yl)-1,3-dioxolan-4-yl)methanol, (2-(4-methylpent-2-en-1-yl)-1,3-dioxolan-4-yl)methanol, (2-(but-3-en-1-yl)-1,3-dioxolan-4-yl)methanol, (2-(pent-3-en-1-yl)-1,3-dioxolan-4-yl)methanol, (2-(hex-3-en-1-yl)-1,3-dioxolan-4-yl)methanol, (2-(2-methylpent-3-en-1-yl)-1,3-dioxolan-4-yl)methanol, (2-(pent-4-en-1-yl)-1,3-dioxolan-4-yl)methanol, (2-(hex-4-en-1-yl)-1,3-dioxolan-4-yl)methanol, (2-(3-methylpent-4-en-1-yl)-1,3-dioxolan-4-yl)methanol, (2-(2-methylpent-4-en-1-yl)-1,3-dioxolan-4-yl)methanol, and (2-(hex-5-en-1-yl)-1,3-dioxolan-4-yl) methanol.

In a further aspect, $R_1$ and $R_2$ both contain carbon atoms. In this regard when $R_1$ and $R_2$ are alkyl groups particularly preferred compounds are selected from the group consisting of: (2,2-dimethyl-1,3-dioxolan-4-yl)methanol, (2-ethyl-2-methyl-1,3-dioxolan-4-yl)methanol, (2-methyl-2-propyl-1,3-dioxolan-4-yl)methanol, (2-butyl-2-methyl-1,3-dioxolan-4-yl)methanol, (2-methyl-2-pentyl-1,3-dioxolan-4-yl) methanol, (2-isopentyl-2-methyl-1,3-dioxolan-4-yl) methanol, (2-methyl-2-(2-methylbutyl)-1,3-dioxolan-4-yl) methanol, (2-isobutyl-2-methyl-1,3-dioxolan-4-yl) methanol, (2-methyl-2-neopentyl-1,3-dioxolan-4-yl) methanol, (2,2-diethyl-1,3-dioxolan-4-yl)methanol, (2-ethyl-2-propyl-1,3-dioxolan-4-yl)methanol, (2-butyl-2-ethyl-1,3-dioxolan-4-yl)methanol, (2-ethyl-2-isobutyl-1,3-dioxolan-4-yl)methanol, and (2-2-dipropyl-1,3-dioxolan-4-yl)methanol. In another aspect at least one $R_1$ or $R_2$ group is alkenyl. Particularly preferred vinyl containing (1,3-dioxolan-4-yl)methanol containing compounds are selected from the group consisting of: (2-methyl-2-vinyl-1,3-dioxolan-4-yl)methanol, (2-methyl-2-(prop-1-en-1-yl)-1,3-dioxolan-4-yl)methanol, (2-(but-1-en-1-yl)-2-methyl-1,3-dioxolan-4-yl)methanol, 2-methyl-2-(pent-1-en-1-yl)-1,3-dioxolan-4-yl)methanol, 2-methyl-2-(3methylbut-1-en-1-yl)-1,3-dioxolan-4-yl)methanol, 2-(but-1-en-1-yl)-2-ethyl-1,3-dioxolan-4-yl)methanol, 2-allyl-2methyl-1,3-dioxolan-4-yl) methanol, (2-(but-2-en-1-yl)-2-methyl-1,3-dioxolan-4-yl) methanol, (2-methyl-2-(pent-2-en-1-yl)-2-methyl-1,3-dioxolan-4-yl)methanol, (2-(but-1-en-1-yl)-2-ethyl-1,3-dioxolan-4-yl)methanol, (2-(but-3-en-1-yl)-2-methyl-1,3-dioxolan-4-yl)methanol, (2-methyl-2-(pent-3-en-1-yl)-2-methyl-1,3-dioxolan-4-yl)methanol, (2-methyl-2-(pent-4-en-1-yl)-1,3-dioxolan-4-yl)methanol. In one aspect $R_1$ and $R_2$ are alkyl groups having a sum of five or less carbon atoms with (2,2-dimethyl-1,3-dioxolan-4-yl)methanol, (2-ethyl-2-methyl-1,3-dioxolan-4-yl)methanol, and 2,2diethyl-1,3-dioxolan-4yl)methanol being particularly suited.

The lubricating oil composition described above may further comprise at least one oil soluble additive selected from dispersants, detergents, antiwear agents, extreme pressure agents, antioxidants, rust inhibitors, corrosion inhibitors, pour point depressants, viscosity index improvers, and friction modifiers. In one embodiment, the at least one additive is a metal-containing detergent in an amount from 0.25 to 3 wt % based upon the total amount of the lubricating oil composition, more preferably a metal sulfonate.

In another aspect, the lubricating oil composition of comprises a major amount of an oil of lubricating viscosity; and from 0.1 to 1.5 weight % based upon the total lubricating oil composition of a 1,3-dioxolane-4-methanol compound of the formula I.

A further embodiment is directed to a method for reducing wear on a gear surface or in an internal combustion engine comprising operating said gear or engine with a lubricating oil composition according to any one of the preceding compounds. Thus, it is directed to the use of a substituted 1,3-dioxolane-4-methanol compound of the formula I in a lubricating oil composition for providing antiwear protection in engines and gear sets. The use of these compounds to provide wear protection is particularly suited for use in engine oils, hydraulic oils and functional fluids such as tractor hydraulic fluids.

A feature of the present invention is directed to the free hydroxyl group of the 1,3-dioxolane moiety. While not wishing to be bound to any theory, it is thought that the 3-dioxolane-4-methanol compounds of the formula I may form a protective film under boundary lubrication conditions. It is believed that the free hydroxyl group is necessary to hydrogen bond to the metal surface and form this protective film. Thus, a key aspect of this invention is the presence of this free hydroxyl group.

DETAILED DESCRIPTION

Many of ketals and acetals of formula I, and methods for their preparation from glycerol, are known in the art. Typically, dioxolanes of formula I are prepared by reacting glycerol with a suitable linear, branched, or cyclic ketone or aldehyde in the presence of an acid catalyst, and under conditions allowing for removal of the water formed in the reaction. The removal of water is typically accomplished by a distillation if the boiling point of the ketone and aldehyde are both sufficiently above the boiling point of water, or by an azeotropic distillation with a suitable co-solvent. Dioxolanes of formula I can also be prepared by trans-ketalization or trans-acetalization of ketals or acetals of formula II with glycerol:

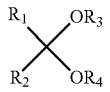

wherein $R_3$ and $R_4$ are independently selected from a $C_1$-$C_6$ linear or branched alkyl.

Suitable glyceryl ketals and acetals are compounds typically formed from glycerol and simple and inexpensive ketones and aldehydes that are readily available at industrial scale. Non-limiting examples of such ketones and aldehydes include acetone, methyl ethyl ketone, methyl isobutyl ketone, diethylketone, alkyl isopropyl ketones, pentan-2-one, hexan-2-one, hexan-3-one. Vinyl ketone may also be used such as but-3-en-2-one, pent-3-en-2-one, hex-3-en-2-one, hex-4-en-2-one and the like. Also useful are cyclohexanone, cyclopentanone, cycloheptanone, cyclohexa-2-enone, cyclohexa-3-enone, cyclohexa-2,5-dienone. Particularly preferred ketones are derived from linear or branched aliphatic ketones having 6 or less carbon atoms such as propane-2-one, butan-2-one, pentan-2-one, hexan-2one, 3-methylbutan-2-one, 3-methylpentane-2-one, pentane-3-one, 2-methylpentan-3-one. Cyclic ketones may be employed preferably having less than 6 or less carbon atoms, such as cyclopropanone, cyclobutanone, cyclopentanone, cyclohexanone, 2-methylcyclopentanone, 3-methylcyclopentanone. Particularly preferred aldehydes include formaldehyde and linear or branched aliphatic aldehydes, such as preferably, having 6 or less carbon atoms such as acetaldehyde, propionaldehyde, butyraldehyde, isobutyraldehyde, 3-methylbutanal, 2,3-dimethylbutanal, 2-ethylbutanal, 3-methylpentanal, and may include cyclopentanecarbaldehyde.

Acetals of glycerol and linear or branched aliphatic aldehydes commonly exist as an equilibrating mixture of 1,2-acetals (4-hydroxymethyl-1,3-dioxolanes) and 1,3-acetals (2-ethyl-5-hydroxy-1,3-dioxanes). Even in such mixtures, they are suitable for use in the lubricating oil compositions without further separation. Preferred are the 1,2 acetals and preferably are in the majority, more particularly greater than 80% and more preferably greater than 90% by weight (up to 100%).

The reaction between glycerol and a suitable aldehyde or ketone are well known in the art, see for example U.S. Pat.

Nos. 3,470,206; 4,075,228; 5,268,007. Typically the reaction is carried out in the presence of a suitable catalyst. Catalysts can include various acids, and other catalysts known in the art. Non-limiting examples of such catalysts include strong mineral acids, such as sulfuric, hydrochloric, hydrofluoroboric, hydrobromic acids, p-toluenesulfonic acid, camphorosulfonic acid, methanesulfonic acid, and the like. Various resins that contain protonated sulfonic acid groups are also useful as they can be easily recovered after completion of the reaction. Examples of suitable acids further include Lewis acids, for example, boron trifluoride and various complexes of $BF_3$, exemplified by $BF_3$ diethyl etherate. Other non-limiting examples of useful Lewis acids include halides of tin, titanium, aluminum, iron, silica, acidic alumina, titania, zirconia, various acidic clays, and mixed aluminum or magnesium oxides. Activated carbon derivatives comprising mineral, sulfonic, or Lewis acid derivatives can also be used.

The present disclosure is not limited to a specific catalyst or an amount of catalyst. One of ordinary skill in the art can practice many variations on the part of the catalyst composition and the amounts used. Elevated temperatures may be used to accelerate the reaction with less reactive catalysts, however, the temperature of the reaction mixture is not critical for succeeding in making a quantity of the product, as even with less active catalysts the reaction still proceeds to yield the desired compounds. The amount and type of catalyst depends on the specific chemical composition of the glycerol and aldehyde/ketone, used in a reaction and can be readily established by one skilled in the art.

The reaction can be carried out in the presence of an optional co-solvent that is substantially inert under the reaction conditions and is often removed at the end of the reaction by distillation. Typically, it is desired to use a sufficient quantity of a co-solvent to minimize cross-linking via ether bond formation. Non-limiting examples of suitable co-solvents include saturated hydrocarbons, aromatics, ethers, and polyethers. Any excess solvent remaining after completion of the reaction can be removed by distillation at normal or reduced pressure.

Other suitable processes include procedures for making the more optically active dioxolanes and comprise reacting D- or L-serine with sodium nitrite in an aqueous solution in the presence of formic acid, acetic acid, or propanoic acid to prepare 2,3-dihydroxypropanoic acid (D- or L-glyceric acid), the aqueous solution comprising from about 0.1 to 0.5 liter of water per mole of the serine starting material and from about 0.1 to 0.75 liter of acid per mole of serine; reacting the glyceric acid so formed with 2,2-dimethoxypropane in the presence of methanol to prepare the D- or L-glyceric acid methyl ester (methyl D- or L-glycerate); reacting the glyceric acid methyl ester with 2,2-dimethoxypropane in the presence of an acid to produce methyl 2,3-O-isopropylidene-D- or L-glycerate; and adding a solution of the methyl 2,3-O-isopropylidene-glycerate to lithium aluminum hydride to produce the D- or L-solketal, (S)-(+)- or (R)-(−)-2,2-dimethyl-1,3-dioxolane-4-methanol, see for example U.S. Pat. No. 4,575,558. Alternatively, the glyceric acid can be reacted with the 2,2-dimethoxypropane without methanol to prepare 2,3-O-isopropylidene D- or L-glyceric acid which is then reacted with lithium aluminum hydride to produce the solketal. Many suitable methods may be employed to prepare the 1,3-dioxolane-4-methanol compound of the formula I.

The 1,3-dioxolane-4-methanol compound of the formula I is advantageously employed in a lubricating oil composition. When employed in a lubricating oil composition it comprises a major amount of an oil of lubricating viscosity (major amount being greater than 50% by weight of the total composition, preferably more than 60%) and a minor amount of the 1,3-dioxolane-4-methanol compound of the formula I. For finished lubricants, typically the amount of 1,3-dioxolane-4-methanol compound of the formula I will be from about 0.01 wt % to about 10 wt % based upon the total composition. Preferably the 1,3-dioxolane-4-methanol compound of the formula I is employed in a amount from 0.05 wt % to about 5 wt % and even more preferably from about 0.1 wt % to 1.5 wt % based upon the total weight of the lubricating oil composition.

The lubricating oil compositions of this invention can be used in the lubrication of essentially any internal composition engine, including automobile and truck engines, two cycle engines, diesel engines, aviation piston engines, marine and railroad engines and the like. Also contemplated are lubricating oils for gas fired engines, alcohol (e.g. methanol) powered engines, stationery powered engines, turbines and the like. Particularly useful are heavy duty diesel engines wherein said lubricating oil compositions of this invention can be employed to improve wear and wherein the 1,3-dioxolane-4-methanol compound of the formula I may provide a frictional benefit to the lubricating oil composition. In this aspect, crankcase engine lubricating oil formulations for diesel and gasoline engines are as disclosed with at least one additional additive. More particularly the additive may be a detergent and preferably a sulfonate detergent described herein.

The 1,3-dioxolane-4-methanol compound of the formula I may also be employed in a functional fluid, which is a term which encompasses a variety of fluids including but not limited to tractor hydraulic fluids, transmission fluids including automatic transmission fluids, continuously variable transmission fluids and manual transmission fluids, hydraulic fluids, gear oils, power steering fluids, and fluids related to power train components. It should be noted that within each of these fluids such as, for example, automatic transmission fluids, there are a variety of different types of fluids due to the various transmissions having different designs which have led to the need for fluids of markedly different functional characteristics. In one aspect the functional fluid is a tractor hydraulic fluid. A tractor fluid is an all-purpose product used for all lubricant applications in a tractor except for lubricating the engine. These applications may include lubrication of gearboxes, power take-off and clutch(es), rear axles, reduction gears, wet brakes, and hydraulic accessories. The components included within a tractor fluid must be carefully chosen so that the final resulting fluid composition will provide all the necessary characteristics required in the different applications. Such characteristics may include the ability to provide proper frictional properties for preventing wet brake chatter of oil immersed brakes while simultaneously providing the ability to actuate wet brakes and provide power take-off (PTO) clutch performance. A tractor fluid must provide sufficient antiwear and extreme pressure properties as well as water tolerance/filterability capabilities. The extreme pressure (EP) properties of tractor fluids, important in gearing applications, may be demonstrated by the ability of the fluid to pass a spiral bevel test as well as a straight spur gear test. The tractor fluid may need to pass wet brake chatter tests while providing adequate wet brake capacity when used in oil immersed disk brakes which are comprised of a bronze, graphitic-compositions and asbestos. The tractor fluid may need to demonstrate its ability to provide friction retention for power shift transmission clutches such as those clutches which include graphitic and bronze clutches.

In another embodiment the functional fluid is an automatic transmission fluid. Automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail.

If desired, other additives known in the art may be added to the lubricating oil basestock. Such additives include dispersants, detergents, antiwear agents, extreme pressure agents, antioxidants, rust inhibitors, corrosion inhibitors, pour point depressants, viscosity index improvers, other friction modifiers and the like. Not limiting examples of such are herein below.

The oil of lubricating viscosity for use in the lubricating oil compositions of this invention, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered base oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but is not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$ to $C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The ashless dispersant compounds employed in the lubricating oil composition of the present invention are generally used to maintain in suspension insoluble materials resulting from oxidation during use, thus preventing sludge flocculation and precipitation or deposition on metal parts. The lubricating oil composition of the present invention may contain one or more ashless dispersants. Nitrogen-containing ashless (metal-free) dispersants are basic, and contribute to the total base number or TBN (as can be measured by ASTM D2896) of a lubricating oil composition to which they are added, without introducing additional sulfated ash. The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test. An ashless dispersant generally comprises an oil soluble polymeric hydrocarbon backbone having functional groups that are capable of associating with particles to be dispersed. Many types of ashless dispersants are known in the art.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersants. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants is bissuccinimides having a hydrocarbyl group attached to the maleic moiety wherein each group is independently a hydrocarbyl group, such as a polyolefin-derived group. Typically the hydrocarbyl group is an alkyl group, such as a polyisobutyl group. Alternatively expressed, the hydrocarbyl groups can contain about 40 to about 500 carbon atoms, and these atoms may be present in aliphatic forms. The polyamines are alkylene polyamines wherein the alkylene group, commonly an ethylene ($C_2H_4$) group.

Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Certain fundamental types of succinimides and the related materials encompassed by the term of art "succinimide" are taught in U.S. Pat. Nos. 3,172,892; 3,219,666 and 3,272,746, the content of which is incorporated by reference herein. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine. Examples of ethylene amines include ethylene diamine, diethylene triamine, triethylene tetramine, tetraethylene pentamine and the like. Particularly preferred are those succinimides prepared from polyisobutenyl succinic anhydride of about 70 to about 128 carbon atoms and tetraethylene pentamine or triethylene tetramine and mixtures thereof.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2300, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In a preferred embodiment of the present invention, an ashless dispersant for use in the lubricating oil composition is an ethylene, carbonate-treated bissuccinimide derived from a polyisobutenyl group having a number average molecular weight of about 2300. The dispersant(s) for use in the lubricating oil compositions of the present invention are preferably non-polymeric (e g., are mono- or bissuccinimides).

Generally, the ashless dispersant is present in the lubricating oil composition in an amount ranging from about 3 to about 10 wt. %, and preferably from about 4 to about 8 wt. %, based on the total weight of the lubricating oil composition.

The at least one metal-containing detergent compound employed in the lubricating oil composition of the present invention functions both as a detergent to reduce or remove deposits and as an acid neutralizer or rust inhibitor, thereby reducing wear and corrosion and extending engine life. Detergents generally comprise a polar head with long hydrophobic tail, with the polar head comprising a metal salt of an acid organic compound.

The lubricating oil composition of the present invention may contain one or more detergents, which are normally salts, and especially overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid such as carbon dioxide) with a mixture comprising an acidic organic compound, in a reaction medium comprising at least one inert, organic solvent (such as mineral oil, naphtha, toluene, xylene) in the presence of a stoichiometric excess of a metal base and a promoter.

Useful acidic organic compounds for making the overbased compositions include carboxylic acids, sulfonic acids, phosphorus-containing acids, phenols and mixtures thereof. Preferably, the acidic organic compounds are carboxylic acids or sulfonic acids with sulfonic or thiousulfonic groups (such as hydrocarbyl-substituted benzenesulfonic acids), and hydrocarbyl-substituted salicylic acids.

Carboxylate detergents, e.g., salicylates, can be prepared by reacting an aromatic carboxylic acid with an appropriate metal compound such as an oxide or hydroxide. Neutral or overbased products may then be obtained by methods well known in the art. The aromatic moiety of the aromatic carboxylic acid can contain one or more heteroatoms such as nitrogen and oxygen. Preferably, the moiety contains only carbon atoms. More preferably, the moiety contains six or more carbon atoms, such as a benzene moiety. The aromatic carboxylic acid may contain one or more aromatic moieties, such as one or more benzene rings, optionally fused together or otherwise connected via alkylene bridges. Representative examples of aromatic carboxylic acids include salicylic acids and sulfurized derivatives thereof such as hydrocarbyl substituted salicylic acid and derivatives thereof. Processes for sulfurizing, for example, a hydrocarbyl-substituted salicylic acid, are known to those skilled in the art. Salicylic acids are typically prepared by carboxylation, for example, by the Kolbe-Schmitt process, of phenoxides. In that case, salicylic acids are generally obtained in a diluent in admixture with an uncarboxylated phenol.

Metal salts of phenols and sulfurized phenols are prepared by reaction with an appropriate metal compound such as an oxide or hydroxide. Neutral or overbased products may be obtained by methods well known in the art. For example, sulfurized phenols may be prepared by reacting a phenol with sulfur or a sulfur-containing compound such as hydrogen sulfide, sulfur monohalide or sulfur dihalide, to form products that are mixtures of compounds in which 2 or more phenols are bridged by sulfur-containing bridges.

The metal compounds useful in making the overbased salts are generally any Group I or Group II metal compounds in the Periodic Table of the Elements. Group I metals of the metal base include Group 1a alkali metals (e.g., sodium, potassium, lithium) as well as Group 1b metals such as copper. Group I metals are preferably sodium, potassium, lithium and copper, more preferably sodium or potassium, and particularly preferably sodium. Group II metals of the metal base include Group IIa alkaline earth metals (e.g., magnesium, calcium, strontium, barium) as well as Group IIb metals such as zinc or cadmium. Preferably, the Group II metals are magnesium, calcium, barium, or zinc, more preferably magnesium or calcium, and most preferably calcium.

Examples of the overbased detergents include, but are not limited to, calcium sulfonates, calcium phenates, calcium salicylates, calcium stearates and mixtures thereof. Overbased detergents suitable for use in the lubricating oil compositions of the present invention may be low overbased (e.g., an overbased detergent having a TBN below about 100). The TBN of such a low-overbased detergent may be from about 5 to about 50, or from about 10 to about 30, or from about 15 to about 20. Alternatively, the overbased detergents suitable for use in the lubricating oil compositions of the present invention may be high overbased (e.g., an overbased detergent having a TBN above about 100). The TBN of such a high-overbased detergent may be from about 150 to about 450, or from about 200 to about 350, or from about 250 to about 280. A low-overbased calcium sulfonate detergent with a TBN of about 17 and a high-overbased sulfurized calcium phenate with a TBN of about 400 are two exemplary overbased detergents for use in the lubricating oil compositions of the present invention. The lubricating oil compositions of the present invention may contain more than one overbased detergent, which may be all low-TBN detergents, all high-TBN detergents, or a mixture thereof. For example, the lubricating oil compositions of the present invention may contain a first metal-containing detergent which is an overbased alkaline earth metal sulfonate detergent having a TBN of about 150 to about 450 and a second metal-containing detergent which is an overbased alkaline earth metal sulfonate detergent having a TBN of about 10 to about 50.

Suitable detergents for the lubricating oil compositions of the present invention also include "hybrid" detergents such as, for example, phenate/salicylates, sulfonate/phenates, sulfonate/salicylates, sulfonates/phenates/salicylates, and the like. Examples of hybrid detergents include those described in, for example, U.S. Pat. Nos. 6,153,565; 6,281,179; 6,429,178, and 6,429,179.

Generally, the metal-containing detergent is present in the lubricating oil composition in an amount ranging from about 0.25 to about 3 wt. %, and preferably from about 0.5 to about 2 wt. %, based on the total weight of the lubricating oil composition.

The antioxidant compounds employed in the lubricating oil composition of the present invention reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, ashless oil soluble phenates and sulfurized phenates, alkyl-substituted diphenylamine, alkyl-substituted phenyl and naphthylamines and the like and mixtures thereof. Suitable diphenylamine antioxidants include, but are not limited to, monoalkylated diphenylamine, dialkylated diphenylamine, trialkylated diphenylamine, and the like and mixtures thereof. Representative examples of diphenylamine antioxidants include butyldiphenylamine, di-butyldiphenylamine, octyldiphenylamine, di-octyldiphenylamine, nonyldiphenylamine, di-nonyldiphenylamine, t-butyl-t-octyldiphenylamine, and the like and mixtures thereof.

Generally, the antioxidant compound is present in the lubricating oil composition in an amount ranging from about 0.2 to about 4 wt. %, and preferably from about 0.3 to about 1 wt. %, based on the total weight of the lubricating oil composition.

The anti-wear agent compounds employed in the lubricating oil composition of the present invention include molybdenum-containing complexes such as, for example, a molybdenum/nitrogen-containing complex. Such complexes are known in the art and are described, for example, in U.S. Pat. No. 4,263,152, the content of which is incorporated by reference herein.

Generally, the molybdenum/nitrogen-containing complex can be made with an organic solvent comprising a polar promoter during a complexation step and procedures for preparing such complexes are described, for example, e.g., in U.S. Pat. Nos. 4,259,194; 4,259,195; 4,261,843; 4,263,152; 4,265,773; 4,283,295; 4,285,822; 4,369,119; 4,370,246; 4,394,279; 4,402,840; and 6,962,896 and U.S. Patent Application Publication No. 2005/0209111, the contents of which are incorporated by reference herein. As shown in these references, the molybdenum/nitrogen-containing complex can further be sulfurized.

Generally, the anti-wear agent compounds are present in the lubricating oil composition in an amount ranging from about 0.25 to about 5 wt. %, and preferably from about 0.3 to about 2 wt. %, based on the total weight of the lubricating oil composition.

Preferably a minor amount of antiwear agent, a metal dihydrocarbyl dithiophosphate is added to the lubricant composition. The metal is preferably zinc. The dihydrocarbyldithiophosphate may be present in amount of 0.1 to 2.0 mass percent but typically low phosphorus compositions are desired so the dihydrocarbyldithiophosphate is employed at 0.25 to 1.2, preferably 0.5 to 0.7, mass %, in the lubricating oil composition. Preferably, zinc dialkylthiophosphate (ZnDTP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The hydrocarbyl groups can be a primary, secondary, or mixtures thereof, e.g. the compounds may contains primary and/or secondary alkyl groups derived from primary or secondary carbon atoms. Moreover, when employed, there is preferably at least 50, more preferably 75 or more, most preferably 85 to 100, mass % secondary alkyl groups; an example is a ZnDTP having 85 mass % secondary alkyl groups and 15 mass % primary alkyl groups, such as a ZnDTP made from 85 mass % butan-2-ol and 15 mass % iso-octanol. Even more preferred is a ZnDTP derived from derived from sec-butanol and methylisobutylcarbinol and most preferably wherein the sec-butanol is 75 mole percent.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.10 or less, preferably 0.08 or less, and more preferably 0.075 or less, such as in the range of 0.025 to 0.07.

The lubricating oil compositions of the present invention can be conveniently prepared by simply blending or mixing the lubricating oil and the 1,3-dioxolane-4-methanol compound of the formula I, optionally other additives may be blended such as the ashless dispersant, at least one metal-containing detergent, antioxidant and anti-wear agent, optionally with other additives, with the oil of lubricating viscosity. The 1,3-dioxolane-4-methanol compound of the formula I, ashless dispersant, metal-containing detergent, antioxidant and anti-wear agent may also be preblended as a concentrate or package with various other additives, if desired, in the appropriate ratios to facilitate blending of a lubricating composition containing the desired concentration of additives. The 1,3-dioxolane-4-methanol compound of the formula I, ashless dispersant, at least one metal-containing detergent, antioxidant and anti-wear agent are blended with the base oil using a concentration at which they provide improved friction effect and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C. to 25° C.) can be measured by either actual precipitation from the oil composition or the formulation of a "cloudy" solution which evidences formation of insoluble wax particles.

The lubricating oil compositions of the present invention may also contain other conventional additives for imparting auxiliary functions to give a finished lubricating oil composition in which these additives are dispersed or dissolved. For example, the lubricating oil compositions can be blended with friction modifiers, rust inhibitors, dehazing agents, demulsifying agents, metal deactivating agents, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Examples of supplemental friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof. The friction modifier can be incorporated in the lubricating oil composition in an amount ranging of from about 0.02 to about 2.0 wt. % of the lubricating oil composition, preferably from about 0.05 to about 1.0 wt. %, and more preferably from about 0.1 to about 0.5 wt. %.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of antifoaming agents include, but are not limited to, polymers of alkyl methacrylate; polymers of dimethylsilicone and the like and mixtures thereof.

The lubricating composition of the present invention may also contain a viscosity index improver. Examples of the viscosity index improvers include poly-(alkyl methacrylate), ethylene-propylene copolymer, styrene-butadiene copolymer, and polyisoprene. Viscosity index improvers of the dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of about 0.5 to about 20 wt. % per total amount of the engine oil.

EXAMPLES

The invention will be further illustrated by the following examples, which set forth particularly advantageous embodiments and are not considered limitative of its scope. This application is intended to cover those various changes and substitutions that may be made by those skilled in the art without departing from the spirit and scope of the appended claims.

SYNTHETIC EXAMPLES

The following compounds were prepared or purchased as follows.

Synthetic Example 1

1,3-dioxolane-4-methanol CAS No. 99569-11-6 (also known as glycerol formal is commercially available from Sigma-Aldrich, St. Louis, Mo.)

Synthetic Example 2

2,2-dimethyl-1,3-dioxolane-4-methanol, CAS No. 100-79-8 (commercially available from Sigma-Aldrich, St. Louis, Mo.).

Synthetic Example 3

2-ethyl-2-methyl-1,3-dioxolane-4-methanol—was prepared as follows.

A 250 mL round bottom flask was charged with glycerol (5 grams), 2-butanone (50 mL) and p-toluenesulfonic acid (21 mg). The mixture was heated to reflux temperature for 3 hours. The solution was allowed to cool and the excess 2-butanone was removed in vacuo. The crude material was diluted with methylene chloride and then washed with saturated NaHCO3 and brine. The organic phase was collected, dried over MgSO4 and concentrated in vacuo. The material was used without further purification.

Synthetic Example 4

2-propyl-1,3-dioxolane-4-methanol—was prepared following the above procedure using 25 mL butyraldehyde.

Synthetic Example A 2,2-dipentyl-1,3-dioxolane-4-methanol—was prepared following the above procedure using 11 mL 6-undecanone.

Synthetic Example B 2,2-diphenyl-1,3-dioxolane-4-methanol—was prepared following the above procedure using benzophenone (5 g).

Synthetic Example C 2-undecyl-1,3-dioxolane-4-methanol—was prepared as follows.

A 250 mL round bottom flask was charged with glycerol (2.5 grams), dodecanal (5 grams), p-toluenesulfonic acid (103 milligrams) and toluene (50 milliliters). The flask was fitted with a Dean Stark trap and the solution was heated at reflux for 3 hours. The solution was allowed to cool and then washed with saturated NaHCO3 and brine. The organic phase was collected, dried over MgSO4 and concentrated in vacuo. The product was further purified using silica gel flash column chromatography.

Synthetic Example D

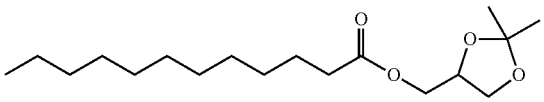

(2,2-dimethyl-1,3-dioxolan-4-yl)methyl docecanoate was prepared as follows.

To a solution of lauryl chloride (3 mL, Sigma-Aldrich, St. Louis, Mo.) and triethylamine (2.6 mL) in 50 mL methylene chloride held at 0° C. was added isopropylidene glycerol (1.57 mL). The reaction was warmed to room temperature and stirred for 15 h. The mixture was washed with saturated NaHCO3. The organic layer was dried over Na2SO4 and concentrated in vacuo. The crude material was further purified using flash chromatography.

Evaluation of Protection Against Wear

The wear performance of lubricating oil compositions containing the compounds employed in the present invention was tested using a Mini-Traction Machine (MTM) tribometer from PCS Instruments (London, U.K.). Two different MTM bench tests were conducted to more fully assess the wear performance of lubricating oil compositions containing the compounds employed in the present invention. In the first MTM test, the compounds employed in the present invention were screened for wear performance in a 100N Group II base oil at a constant load. In the second MTM test, a higher load was run to assess the resistance of some fully formulated lubricating oil compositions to higher loads.

For the MTM screener test, the MTM tribometer (PCS Instruments, London, U.K.) was set up to run in pin-on-disk mode using polished disks of 52100 steel from PCS Instruments, and a 0.25 inch stationary ball bearing, also of 52100 steel from Falex Corporation, in place of a pin [Yamaguchi, E. S., "Friction and Wear Measurements Using a Modified MTM Tribometer," IP.com Journal 7, Vol. 2, 9, pp 57-58 (August 2002), No. IPCOM000009117D]. The test was conducted at 100° C. for 40 minutes at 7 Newtons load and a sliding speed of 200 mm/s following a break-in period of 5 minutes at 0.1 Newtons and a sliding speed of 2000 mm/s. The wear scars on the balls were measured manually on an optical microscope and recorded.

MTM screener tests results are presented in Table 1. Test results from the base oil alone a Chevron 100N Group II base oil (Baseline A, Performance Example A); the base oil top-treated with a commercially available zinc dialkyldithiophosphate, 1.0 weight % (12 mM) of a zinc dialkyldithiophosphate (Performance Example A1); the base oil top-treated with glycerol mono-oleate 1.79 weight % (50 mM) (Performance Example A2); the base oil top-treated with 2,2-dipentyl-1,3-dioxolane-4-methanol 1.4 weight % (50 mM) (performance Example A3); the base oil top-treated with 2,2-diphenyl-1,3-dioxolane-4-methanol 1.5 weight % (50 mM) (performance Example A4); and the base oil top-treated with (2,2-dimethyl-1,3-dioxolan-4-yl)methyl docecanoate 2.0 weight % (50 mM) (performance Example A5) are included for comparison purposes. Glycerol mono-oleate is a commercially available friction modifier that also gives an antiwear benefit. Lower wear scar diameter values correspond to improved antiwear performance. Performance Example 1 is the base oil top-treated with 2,2-dimethyl-1,3-dioxolane-4-methanol, 0.66 weight % (50 mM), see Synthetic Example 2.

TABLE 1

MTM Screener Results

| Performance Example | Antiwear Additive | Amount mM | Wear Scar Diameter (μm) |
|---|---|---|---|
| Ex. A | — | | 284 |
| Ex. A1 | ZnDTP | 12 | 125 |
| Ex. A2 | Glycerol mono-oleate | 50 | 107 |
| Ex. A3 | 2,2-dipentyl-1,3-dioxolane-4-methanol | 50 | 372 |
| Ex. A4 | 2,2-diphenyl-1,3-dioxolane-4-methanol | 50 | 262 |
| Ex. A5 | (2,2-dimethyl-1,3-dioxolan-4-yl)methyl docecanoate | 50 | 232 |
| Ex. 1 | 2,2-dimethyl-1,3-dioxolane-4-methanol | 50 | 102 |

The results demonstrate that the lubricating oil compositions of the present invention demonstrate superior wear performance to lubricating oil compositions containing zinc dialkyldithiophosphates and comparable wear performance to a lubricating oil composition containing glycerol mono-oleate. The results further outline that bulkier alkyl groups and phenyl groups on the 1,3-dioxolane-4-methanol moiety detract from the wear protection ability and are detrimental (increase wear) or provide little benefit to the baseoil. Example Ex. 5A further demonstrates that an 1,3-dioxolane ester has relatively poor antiwear performance.

A second higher load MTM test was performed in an additized lubricating oil. Formulated lubricating oil compositions containing the compounds employed in the present invention were prepared and assessed for wear performance. The MTM instrument was modified so that a ¼-in. diameter Falex 52100 steel test ball (with special holder) was substituted for the pin holder that came with the instrument The instrument was used in the pin-on-disk mode and run under sliding conditions. It is achieved by fixing the ball rigidly in the special holder, such that the ball has only one degree of freedom, to slide on the disk. The conditions are shown in Table 2.

TABLE 2

| Test Conditions for Higher load MTM | | |
|---|---|---|
| Load | 14N | |
| Initial Contact Pressure | 1.53 GPa | |
| Temperature | 100° C. | |
| Tribocouple | 52100/52100 | |
| Speed | mm/Sec. | Min. |
| | 3800 | 10 |
| | 2000 | 10 |
| | 1000 | 10 |
| | 100 | 10 |
| | 20 | 10 |
| | 10 | 10 |
| | 5 | 10 |
| Length of Time | 70 Min. Test | |
| Diesel Engine Soot | 9% | |

Engine soot obtained from the overhead recovery system of an engine testing facility was used for this test. The soot was made into a slurry with pentane, filtered through a sintered glass funnel, dried in a vacuum oven under an $N_2$ atmosphere and ground to 50 mesh (300 μm) maximum before use. The objective of this action was to make reproducible particles that would give rise to abrasive wear as seen in modern Diesel engines. To prepare the test specimens, the anti-corrosion coating of the PCS Instruments 52100 smooth (0.02 micron $R_a$), steel discs was removed using heptane, hexane, and isooctane. Then, the discs were wiped clean with a soft tissue and submersed in a beaker of the cleaning solvent until the film on the disc track had been removed, and the track of the disc appeared shiny. The discs and test balls were placed in individual containers and submerged in Chevron 450 thinner. Lastly, the test specimens were ultrasonically cleaned by placing them in a sonicator for 20 minutes.

Wear results from the bench tests are presented in below. Lower values indicate less wear. The formulated lubricating oil composition was prepared:

Baseline B

A 5W-30 oil (SAE viscosity grade) baseline lubricating oil composition was prepared using the following additives: approximately 7.5 wt % of a 2300 MW polyalkylsuccinimide post treated with ethylene carbonate, a mixture of low overbased (17 TBN) and high overbased (250 TBN) calcium sulfonates, a 410 TBN calcium alkyl toluene sulfonate, 0.3 wt. % of a diphenylamine antioxidant, 0.2 wt % of a molybdenum/nitrogen containing complex, and a viscosity index improver, a pour point depressant and a foam inhibitor to a majority of a Group II baseoil. The Baseline B was tested in the MTM test and the results are listed in Table 2 (Performance Example B).

Performance Example B1, the base oil top-treated with a commercially available zinc dialkyldithiophosphate, 1.0 weight % (15 mM) of a zinc dialkyldithiophosphate (Performance Example B1); the base oil top-treated with 2,2-dipentyl-1,3-dioxolane-4-methanol 1.0 weight % for preparation see Synthetic Example A (Performance Example B2); the base oil top-treated with 1,3-dioxolane-4-methanol 1.0 weight %, see Synthetic Example 1 (Performance Example 3). Performance Examples 4-6 were prepared by top treating Baseline B with 1.0 wt % based upon the total weight of the lubricating oil composition of Synthetic Examples 2-4

MTM test results are presented in Table 3. Test results from a lubricating oil composition without an antiwear additive (Example B) and lubricating oil composition containing a zinc dialkyldithiophosphate (Example B1) and lubricating oil composition containing 2,2-dipentyl-1,3-dioxolane-4-methanol (Example B2) are included for comparison purposes.

TABLE 3

| Higher Load MTM Test Results | | |
|---|---|---|
| Performance Examples | Antiwear Additive (1.0 wt %) | Wear Scar Diameter * (μm) |
| Ex. B | — | 613 |
| Ex. B1 | ZnDTP | 360 |
| Ex. B2 | 2,2-dipentyl-1,3-dioxolane-4-methanol | 538 |
| Ex. 3 | 1,3-dioxolane-4-methanol | 416 |
| Ex. 4 | 2,2-dimethyl-1,3-dioxolane-4-methanol | 343 |
| Ex. 5 | 2-ethyl-2-methyl-1,3-dioxolane-4-methanol | 293 |
| Ex. 6 | 2-propyl-1,3-dioxolane-4-methanol | 484 |

* Average of two runs

The results demonstrate that the lubricating oil compositions of the present invention demonstrate superior antiwear performance to a lubricating oil composition containing a zinc dialkyldithiophosphate in the second MTM profile. In fact several of the 1,3-dixolane-4-methanol compounds surprisingly performed as well or better than ZnDTP. As illustrated by Example Ex. B2 the carbon length imparts an effect on the wear scar.

The antiwear ability of the 1,3-dioxolane-4-methanol compound of the formula I in a lubricating oil are further demonstrated in the FZG gear test. Slow speed gear performance is evaluated using the S 19-5 test. In this test, an FZG stand is operated for 120 hours under controlled conditions of speed (9 rpm input speed, 13 rpm pinion speed), load (tenth stage) and temperature (90° C. for 40 hours, 120° C. for 40 hours and 90° C. for 40 hours). The test gears are lubricated with the test oil. The gear and pinion are weighed before and after the test. The gear weight loss and pinion weight loss are used to evaluate the wear obtained with the test fluid. In order to pass the test, the total weight loss (gear weight loss+pinion weight loss) must be less than 30 mg.

Slow speed gear performance results are presented in Table 4. Test results from lubricating oil compositions containing a variety of different friction modifiers are included for comparison purposes. If the test resulted in a total weight loss of more than 30 mg at 80 hours, the test was discontinued at that point. Baseline C included 18 mM of a zinc dialkyldithiophosphate derived from primary alcohol, a mixture of a high overbased and a low overbased calcium sulfonate in majority of a Group II base oil. Performance Example C was the Baseline C alone. Performance Example C1 was prepared by top-treating the baseline formulation (Baseline C) with 0.5 wt. % of a glycerin oleyl ether (available commercially from Asahi Denka Kogyo K.K. as ADEKA FM-618C). Performance Example C2 was prepared by top-treating the baseline formulation (Baseline C) with 0.5 wt. % of a 1,3 Butandiol (available commercially from Sigma Aldrich); Performance Example C3 was prepared by top-treating the baseline formulation (Baseline C) with 0.5 wt. % of a commercially available glycerol mono-oleate (above); the base oil top-treated with 2,2-dimethyl-1,3-dioxolane-4-methanol 0.15 weight % (Performance Example 7). The results are presented in Table 4 below.

TABLE 4

S19-5 Slow Speed Gear Performance Results

| Performance Example | Antiwear Additive | Amount in Finished Oil (wt %) | Total Weight Loss at 80 hr (mg) | Pass/Fail |
|---|---|---|---|---|
| Ex. C | — | — | 767 | Fail |
| Ex. C1 | Glycerin oleyl ether | 0.5 | 185 | Fail |
| Ex. C2 | 1,3 Butandiol | 0.5 | 346 | Fail |
| Ex. C3 | Glycerol mono-oleate | 0.5 | 10 | Pass |
| Ex. 7 | 2,2-dimethyl-1,3-dioxolane-4-methanol | 0.15 | 7 | Pass |

The results demonstrate that a lubricating oil composition with a small amount of a 1,3-dioxolane-4-methanol compound of the formula I provides additional antiwear properties to a formulated oil and thus demonstrate suitable slow speed gear protection. The equivalent level of protection is at a lower treat rate that glycerol mono-oleate and thus the 1,3-dioxolane-4-methanol compound of the formula I in a lubricating oil composition may serve as an alternative antiwear/friction modifier additive in similar applications.

What is claimed is:

1. A lubricating oil composition comprising a major amount of an oil of lubricating viscosity; and from 0.05 to 10 weight % based upon the total lubricating oil composition of a 1,3-dioxolane-4-methanol compound of the formula I:

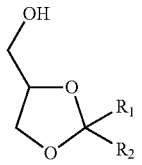

wherein: $R_1$ and $R_2$ are each independently hydrogen, alkyl or alkenyl, wherein the sum of carbon atoms for $R_1$ and $R_2$ is 6 carbon atoms or less.

2. The lubricating oil composition of claim 1, where $R_1$ is hydrogen and $R_2$ is alkyl from 1 to 6 carbon atoms.

3. The lubricating composition of claim 1 wherein the compound of formula I is selected from the group consisting of: (2-methyl-1,3-dioxolan-4-yl)methanol, (2-ethyl-1,3-dioxolan-4-yl)methanol, (2-propyl-1,3-dioxolan-4-yl)methanol, (2-pentyl-1,3-dioxolan-4-yl)methanol, (2-hexyl-1,3-dioxolan-4-yl)methanol(2-methyl-1,3-dioxolan-4-yl) methanol, (2-sec-butyl)-1,3-dioxolan-4-yl)methanol, (2-pentan-2-yl)-1,3-dioxolan-4-yl)methanol, (2-hexyl-2-yl)-1,3-dioxolan-4-yl)methanol, (2-(3-methylpentan-2-ylpentan-2yl)-1,3-dioxolan-4-yl)methanol, (2-(4-methylpentan-2-ylpentan-2yl)-1,3-dioxolan-4-yl)methanol, (2-isopentyl-1,3-dioxolan-4-yl)methanol, (2-(2,3-dimethylbutyl)-1,3-dioxolan-4-yl)methanol, (2-(3,3-dimethylbutyl)-1,3-dioxolan-4-yl)methanol, and (2-neopentyl-1,3-dioxolan-4-yl)methanol.

4. The lubricating oil composition of claim 1, where $R_1$ is hydrogen and $R_2$ is alkenyl from 1 to 6 carbon atoms.

5. The lubricating composition of claim 1 wherein the compound of formula I is selected from the group consisting of: (2-vinyl-1,3-dioxolan-4-yl)methanol,(2-(prop-1-en-1-yl)-1,3-dioxolan-4-yl)methanol, (2-(but-1-en-1-yl)-1,3-dioxolan-4-yl)methanol, (2-(pent-1-en-1-yl) -1,3-dioxolan-4-yl)methanol, (2-(3-methylbut-1-en-1-yl) -1,3-dioxolan-4-yl) methanol,(2-allyl-1,3-dioxolan-4-yl)methanol, (2-(but-2-en-1-yl)-1,3-dioxolan-4-yl)methanol, (2-(pent-2-en-1-yl)-1,3-dioxolan-4-yl)methanol, (2-(hex-2-en-1-yl)-1,3-dioxolan-4-yl)methanol, (2-(4-methylpent-2-en-1-yl)-1,3-dioxolan-4-yl)methanol, (2-(but-3-en-1-yl)-1,3-dioxolan-4-yl) methanol,(2-(pent-3-en-1-yl)-1,3-dioxolan-4-yl)methanol, (2-(hex-3-en-1-yl)-1,3-dioxolan-4-yl)methanol, (2-(2-methylpent-3-en-1-yl)-1,3-dioxolan-4-yl)methanol, (2-(pent-4-en-1-yl)-1,3-dioxolan-4-yl)methanol, (2-(hex-4-en-1-yl)-1,3-dioxolan-4-yl)methanol, (2-(3-methylpent-4-en-1-yl)-1,3-dioxolan-4-yl)methanol, (2-(2-methylpent-4-en-1-yl)-1,3-dioxolan-4-yl)methanol, and (2-(hex-5-en-1-yl)-1,3-dioxolan-4-yl)methanol.

6. The lubricating oil composition of claim 1, wherein $R_1$ and $R_2$ each contain carbon atoms.

7. The lubricating oil composition of claim 6, wherein $R_1$ and $R_2$ are alkyl group.

8. The lubricating oil composition of claim 1 wherein the compound of formula I is selected from the group consisting of: (2,2-dimethyl-1,3-dioxolan-4-yl)methanol, (2-ethyl-2-methyl-1,3-dioxolan-4-yl)methanol, (2-methyl-2-propyl-1,3-dioxolan-4-yl)methanol, (2-butyl-2-methyl-1,3-dioxolan-4-yl)methanol, (2-methyl-2-pentyl-1,3-dioxolan-4-yl) methanol, (2-isopentyl-2-methyl-1,3-dioxolan-4-yl) methanol, (2-methyl-2-(2-methylbutyl)-1,3-dioxolan-4-yl) methanol, (2-isobutyl-2-methyl-1,3-dioxolan-4-yl) methanol, (2-methyl-2-neopentyl-1,3-dioxolan-4-yl) methanol, (2,2-diethyl-1,3-dioxolan-4-yl)methanol, (2-ethyl-2-propyl-1,3-dioxolan-4-yl)methanol, (2-butyl-2-ethyl-1,3-dioxolan-4-yl)methanol, (2-ethyl-2-isobutyl-1,3-dioxolan-4-yl)methanol, and (2-2-dipropyl-1,3-dioxolan-4-yl)methanol.

9. The lubricating oil composition of claim 6, wherein at least one $R_1$ and $R_2$ is an alkenyl group.

10. The lubricating oil composition of claim 1 wherein the compound of formula I is selected from the group consisting of: (1,3-dioxolan-4-yl)methanol containing compounds are selected from the group consisting of: (2-methyl-2-vinyl-1,3-dioxolan-4-yl)methanol, (2-methyl-2-(prop-1-en-1-yl)-1,3-dioxolan-4yl)methanol, (2-(but-1-en-1-yl)-2-methyl-1,3-dioxolan-4-yl)methanol, 2-methyl-2-(pent-1-en-1-yl)-1,3-dioxolan-4-yl)methanol, 2-methyl-2-(3methylbut-1-en-1-yl)-1,3-dioxolan-4-yl)methanol,2-(but-1-en-1-yl)-2-ethyl-1,3-dioxolan-4-yl)methanol, 2-allyl-2methyl-1,3-dioxolan-4-yl)methanol, (2-(but-2-en-1-yl)-2-methyl-1,3-dioxolan-4-yl)methanol, (2-methyl-2-(pent-2-en-1-yl)-2-methyl-1,3-dioxolan-4-yl)methanol,(2-(but-1-en-1-yl)-2-ethyl-1,3-dioxolan-4-yl)methanol,(2-(but-3-en-1-yl)-2-methyl-1,3-dioxolan-4-yl)methanol, (2-methyl-2-(pent-3-en-1-yl)-2-methyl-1,3-dioxolan-4-yl)methanol, (2-methyl-2-(pent-4-en-1-yl)-1,3-dioxolan-4-yl)methanol.

11. The lubricating oil composition of claim 1 wherein the compound of formula I is (1,3-dioxolan-4-yl)methanol.

12. The lubricating oil composition of claim 1 wherein the compound of formula I is from 0.1 wt % to 1.5 wt % based upon the total weight of the lubricating oil composition.

13. The lubricating oil composition of claim 1 further comprising at least one additive selected from dispersants, detergents, antiwear agents, extreme pressure agents, antioxidants, rust inhibitors, corrosion inhibitors, pour point depressants, viscosity index improvers, and friction modifiers.

14. The lubricating oil composition of claim 13 wherein the at least one additive is a metal-containing detergent in an amount from 0.25 to 3 wt % based upon the total amount of the lubricating oil composition.

15. A method for reducing wear on a gear surface or in an internal combustion engine comprising operating said gear or engine with a lubricating oil composition according to any one of the preceding claims.

* * * * *